US008742689B2

(12) United States Patent
Chu

(10) Patent No.: US 8,742,689 B2
(45) Date of Patent: Jun. 3, 2014

(54) LIGHT EMITTING DIODE DRIVING APPARATUS

(75) Inventor: Kwan-Jen Chu, Hsinchu (TW)

(73) Assignee: Power Forest Technology Corporation, Hsinchu (TW)

( * ) Notice: Subject to any disclaimer, the term of this patent is extended or adjusted under 35 U.S.C. 154(b) by 654 days.

(21) Appl. No.: 13/034,657

(22) Filed: Feb. 24, 2011

(65) Prior Publication Data

US 2012/0139443 A1 Jun. 7, 2012

(30) Foreign Application Priority Data

Dec. 7, 2010 (TW) ..... 99142594 A

(51) Int. Cl.
*G05F 1/00* (2006.01)

(52) U.S. Cl.
USPC ..... 315/299; 315/209 R; 315/294; 315/307

(58) Field of Classification Search
USPC ..... 315/224, 209 R, 291, 185 R, 186, 192, 315/193, 210, 294, 297, 299, 301, 302, 307, 315/308, 311, 312, 313, 361, 362
See application file for complete search history.

(56) References Cited

U.S. PATENT DOCUMENTS

| | | | | |
|---|---|---|---|---|
| 2009/0128045 | A1* | 5/2009 | Szczeszynski et al. | 315/185 R |
| 2009/0295775 | A1 | 12/2009 | Kim et al. | |
| 2010/0301760 | A1 | 12/2010 | Liu | |

FOREIGN PATENT DOCUMENTS

| | | |
|---|---|---|
| CN | 101510729 | 8/2009 |
| TW | 200719296 | 5/2007 |
| TW | 200945942 | 11/2009 |
| TW | 201008376 | 2/2010 |

OTHER PUBLICATIONS

"Office Action of Taiwan counterpart application" issued on Sep. 9, 2013, p. 1-p. 6, in which the listed references were cited.
"Office Action of China Counterpart Application", issued on Nov. 20, 2013, p. 1-p. 6, in which the listed references were cited.

* cited by examiner

*Primary Examiner* — Douglas W Owens
*Assistant Examiner* — Jianzi Chen
(74) *Attorney, Agent, or Firm* — Jianq Chyun IP Office

(57) ABSTRACT

A light emitting diode (LED) driving apparatus is provided, and which includes a first operational amplifier (OPA) having a positive input terminal receiving a predetermined voltage related to a current flowing through an LED string; a first resistor having a first end coupled to a negative input terminal of the first OPA and a second end coupled to a ground; a power transistor having a gate coupled to an output of the first OPA, a drain coupled to a cathode of the LED string and a source coupled to the first end of the first resistor; an error amplifier having a first input terminal coupled to the gate of the power transistor, a second input terminal receiving a reference voltage and an output terminal outputting a control voltage; and a power conversion stage providing a DC voltage to an anode of the LED string according to the outputted control voltage.

8 Claims, 2 Drawing Sheets

LIGHT EMITTING DIODE DRIVING APPARATUS

CROSS-REFERENCE TO RELATED APPLICATION

This application claims the priority benefit of Taiwan application serial no. 99142594, filed on Dec. 7, 2010. The entirety of the above-mentioned patent application is hereby incorporated by reference herein and made a part of this specification.

BACKGROUND OF THE INVENTION

1. Field of the Invention

The invention generally relates to a light emitting diode (LED) driving technique, and more particularly, to an LED driving apparatus capable of controlling the flowing current and the operation voltage of LEDs.

2. Description of Related Art

FIG. 1 is a diagram of a conventional LED driving apparatus 10. Referring to FIG. 1, the LED driving apparatus 10 is suitable to drive an LED string 101 comprised by a plurality of LEDs L connected in series. The LED driving apparatus 10 includes a power conversion stage 103, a power transistor Q, a resistor Rcs, an operational amplifier OP, an error amplifier EA, a switch SW, two current sources I1 and I2 and two bipolar junction transistors (BJTs) B1 and B2.

In general, the predetermined voltage $V_{SET}$ received by the positive input terminal (+) of the operational amplifier OP would determine the current flowing through the LED string 101. In this way, the operational amplifier OP can compare a detection voltage Vcs with the predetermined voltage $V_{SET}$ so as to switch the power transistor Q and thereby to keep the current flowing through the LED string 101 as a constant-current. On the other hand, in order to avoid the LED driving apparatus 10 during an operation under constant-current from having excessive power loss (i.e., a product of the current flowing though the LED string 101 and the voltage at the node N1), the control voltage $V_{CTR}$ output from the error amplifier EA is used to control the level of the DC voltage $V_{BUS}$ provided by the power conversion stage 103 for the LED string 101, so that the voltage at the node N1 (i.e., the drain voltage of the power transistor Q) is reduced.

To be specific, the switch SW would be turned on during constant-current operations so that the error amplifier EA would compare the voltage at the node N1 with the reference voltage Vref at the node N3 and then perform error amplification, so as to output the control voltage $V_{CTR}$ to control the level of the DC voltage $V_{BUS}$ provided by the power conversion stage 103. It can be seen from the depiction above that in the conventional LED driving apparatus 10, the level of the DC voltage $V_{BUS}$ provided by the power conversion stage 103 is controlled by a feedback from the drain of the power transistor Q.

However, the architecture of the conventional LED driving apparatus 10 has following problems:

1. A basic voltage $V_{ledmin}$ for determining the reference voltage Vref must vary with the change of the predetermined voltage $V_{SET}$ (i.e., to change the level of the reference voltage Vref);

2. Since the Rds-on of the power transistor Q would be increased with the rise of the temperature during the power transistor Q is turned on (the Rds-on behaves with positive temperature coefficient) so that the basic voltage $V_{ledmin}$ for determining the reference voltage Vref must vary with the change of the temperature (i.e., to change the level of the reference voltage Vref), and thus making the control mechanism of the LED driving apparatus 10 relatively complicated; and 3. During the process of non-dimming (at the time, the current flowing through the LEDs L is zero), since the voltage at the node N1 is a relatively high level (normally, tens of volts), the switch SW must be turned off to avoid the internal components of the LED driving apparatus 10 from damage. Meanwhile, the switch SW should be a high-voltage element.

SUMMARY OF THE INVENTION

Accordingly, the invention is directed to an LED driving apparatus so as to solve the problems of the prior art.

The invention provides an LED driving apparatus suitable to drive at least an LED string. The LED driving apparatus includes a first operational amplifier, a first resistor, a power transistor, an error amplifier and a power conversion stage. The positive input terminal of the first operational amplifier is for receiving a predetermined voltage related to the current flowing through the LED string. The first end of the first resistor is coupled to the negative input terminal of the first operational amplifier and the second end of the first resistor is coupled to a ground.

The gate of the power transistor is coupled to the output terminal of the first operational amplifier, the drain of the power transistor is coupled to the cathode of the LED string and the source of the power transistor is coupled to the first end of the first resistor. The first input terminal of the error amplifier is coupled to the gate of the power transistor, the second input terminal of the error amplifier is for receiving a reference voltage and the output terminal of the error amplifier is for outputting a control voltage. The power conversion stage is coupled between the output terminal of the error amplifier and the anode of the LED string for providing a DC voltage to the anode of the LED string according to the level of the control voltage.

In an embodiment of the invention, the reference voltage is a fixed value, and the fixed value is determined by a voltage value of the first operational amplifier operated in the saturation area.

In an embodiment of the invention, when the voltage of the gate of the power transistor is greater than the reference voltage, the control voltage output from the error amplifier would increase the DC voltage provided by the power conversion stage. On the contrary, when the voltage of the gate of the power transistor is less than the reference voltage, the control voltage output from the error amplifier would decrease the DC voltage provided by the power conversion stage.

Based on the depiction above, in the LED driving apparatus provided by the invention, the level of the DC voltage provided by the power conversion stage is controlled by a feedback from the gate of the power transistor, and the reference voltage received by the error amplifier is designed to be equal to the voltage value of the first operational amplifier operated in the saturation area. Accordingly, in comparison with the prior art, the invention not only substantially simplifies the control mechanism of the LED driving apparatus, but also has no need to change the reference voltage received by the error amplifier (under the situation of changing the current flowing through the LED string) and to adopt the switch for avoiding the internal components of the LED driving apparatus from damage.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
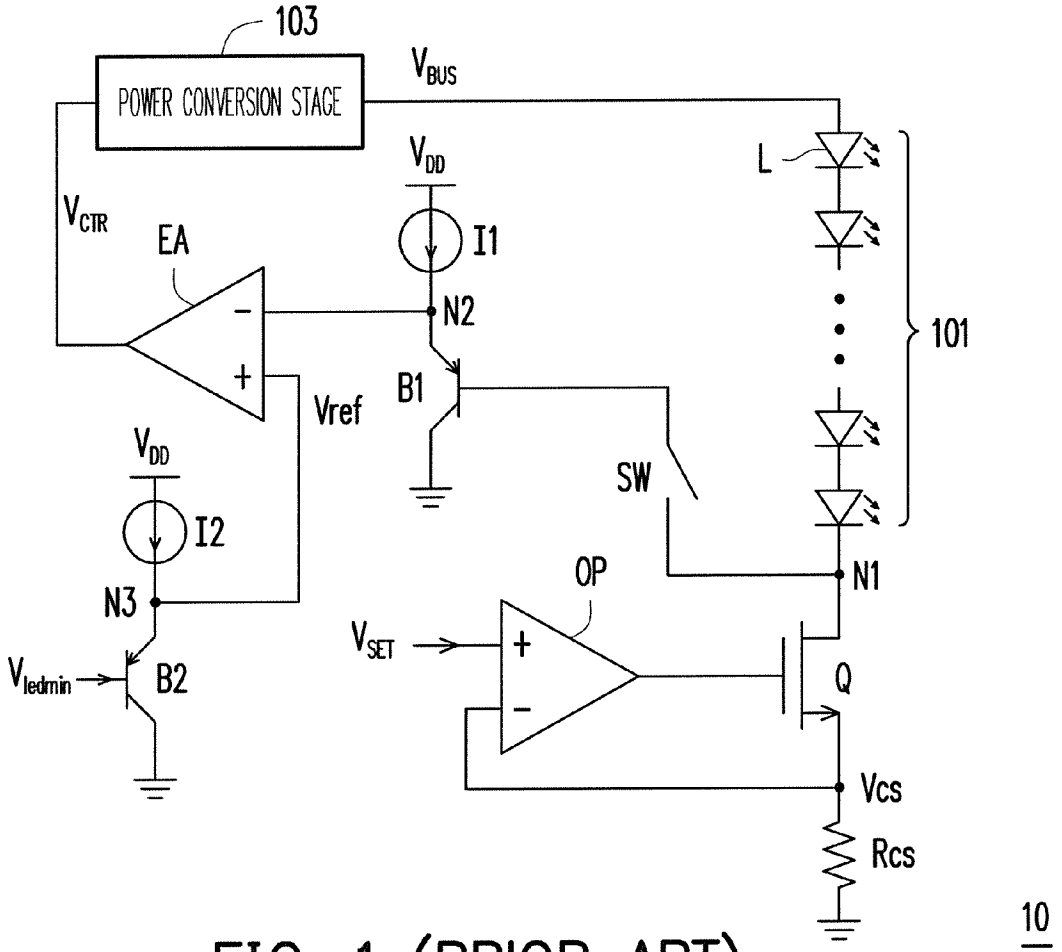
FIG. 1 (PRIOR ART)
FIG. 1 is a diagram of a conventional LED driving apparatus 10.

Reference will now be made in detail to the preferred embodiments of the invention, examples of which are illustrated in the accompanying drawings. Wherever possible, the same reference numbers are used in the drawings and the description to refer to the same or like parts.

Figure 2:
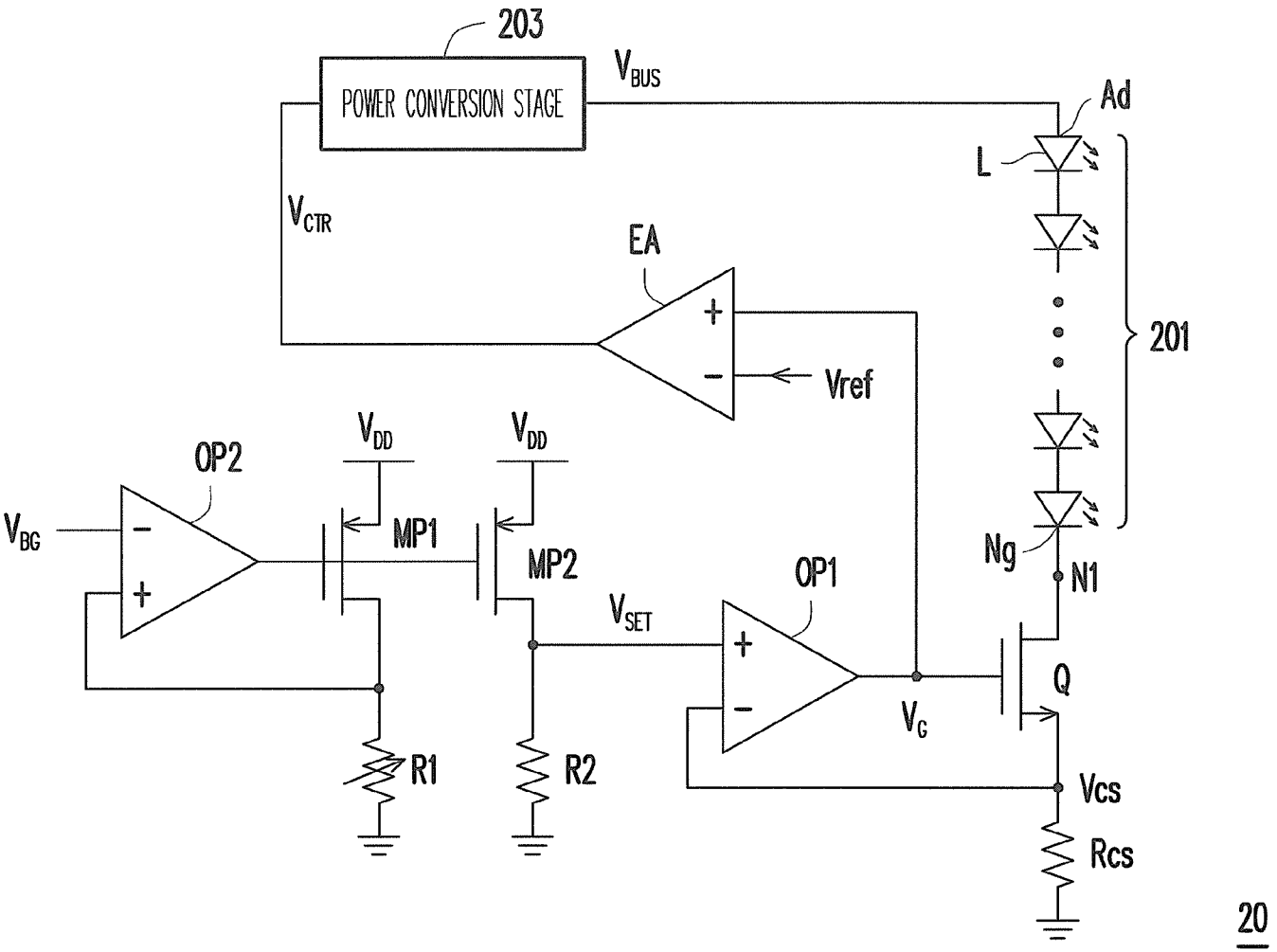
FIG. 2 is a diagram of an LED driving apparatus 20 according to an embodiment of the invention.

FIG. 2 is a diagram of an LED driving apparatus 20 according to an embodiment of the invention. Referring to FIG. 2, the LED driving apparatus 20 is suitable to drive at least an LED string 201 having a plurality of LEDs connected in series, and the LED driving apparatus 20 includes a power conversion stage 203, two operational amplifiers OP1 and OP2, an error amplifier EA, an N-type power transistor Q, a variable resistor R1, two resistors R2 and Rcs and two P-type transistors MP1 and MP2.

In the embodiment, the positive input terminal (+) of the operational amplifier OP1 is for receiving a predetermined voltage $V_{SET}$ related to the current flowing through the LED string 201. The first end of the resistor Rcs is coupled to the negative input terminal (−) of the operational amplifier OP1 and the second end of the resistor Rcs is coupled to a ground. The gate of the N-type power transistor Q is coupled to the output terminal of the operational amplifier OP1, the drain of the N-type power transistor Q is coupled to the cathode Ng of the LED string 201, and the source of the N-type power transistor Q is coupled to the first end of the resistor Rcs.

A first input terminal (for example, a positive input terminal) of the error amplifier EA is coupled to the gate of the N-type power transistor Q, a second input terminal (for example, a negative input terminal) of the error amplifier EA is for receiving a reference voltage Vref, and the output terminal of the error amplifier EA is for outputting a control voltage $V_{CTR}$. The power conversion stage 203 is coupled between the output terminal of the error amplifier EA and the anode Ad of the LED string 201, for providing a DC voltage $V_{BUS}$ to the anode Ad of the LED string 201 according to level of the control voltage $V_{CTR}$ output from the error amplifier EA.

The negative input terminal of the operational amplifier OP2 is for receiving a bandgap voltage $V_{BG}$. The gate of the P-type transistor MP1 is coupled to the output terminal of the operational amplifier OP2, the source of the P-type transistor MP1 is coupled to a system voltage $V_{DD}$, and the drain of the P-type transistor MP1 is coupled to the positive input terminal of the operational amplifier OP2. The first end of the variable resistor R1 is coupled to the positive input terminal of the operational amplifier OP2, and the second end of the variable resistor R1 is coupled to the ground. The gate of the P-type transistor MP2 is coupled to the output terminal of the operational amplifier OP2, the source of the P-type transistor MP2 is coupled to the system voltage $V_{DD}$, and the drain of the P-type transistor MP2 is for producing the predetermined voltage $V_{SET}$. The first end of the resistor R2 is coupled to the drain of the P-type transistor MP2 and the second end of the resistor R2 is coupled to the ground.

In the embodiment, there is a ratio relationship between the resistance of the variable resistor R1 and the resistance of the resistor R2, and the ratio relationship is used to determine the level of the predetermined voltage $V_{SET}$, i.e., the magnitude of the current flowing through the LED string 201. In addition, the reference voltage Vref is a fixed value and the fixed value is determined by the voltage value of the operational amplifier OP1 operated in a saturation area (where the operational amplifier OP1 is operated in a high-gain region). In response to the element characteristic of the N-type power transistor Q, when the gate voltage $V_G$ of the N-type power transistor Q is greater than the reference voltage Vref, the control voltage $V_{CTR}$ output from the error amplifier EA makes the DC voltage $V_{BUS}$ provided by the power conversion stage 203 increase. On the contrary, when the of gate voltage $V_G$ of the N-type power transistor Q is less than the reference voltage Vref, the control voltage $V_{CTR}$ output from the error amplifier EA makes the DC voltage $V_{BUS}$ provided by the power conversion stage 203 decrease.

Based on the depiction above, the predetermined voltage $V_{SET}$ related to the current flowing through the LED string 201 can be determined by adjusting the ratio relationship between the resistance of the variable resistor R1 and the resistance of the resistor R2. In this way, the operational amplifier OP1 can compare the detection voltage Vcs with the determined predetermined voltage $V_{SET}$ to switch the N-type power transistor Q so that the current flowing through the LED string 201 becomes a constant-current. On the other hand, in order to avoid the LED driving apparatus 20 during an operation under constant-current from having excessive power loss (i.e., a product of the current flowing though the LED string 201 and the voltage at the node N1), the control voltage $V_{CTR}$ output from the error amplifier EA is used to control the level of the DC voltage $V_{BUS}$ provided by the power conversion stage 203 for the LED string 201, so that the voltage at the node N1 (i.e., the drain voltage of the N-type power transistor Q) is reduced.

Differently from the prior art however, the embodiment takes the scheme that the level of the DC voltage $V_{BUS}$ provided by the power conversion stage 203 is mainly controlled by a feedback from the gate of the N-type power transistor Q, and the reference voltage Vref received by the error amplifier EA is designed to be equal to the voltage value of the operational amplifier OP1 operated in the saturation area. Hence, when the predetermined voltage $V_{SET}$ is changed, the reference voltage Vref has no need to be changed, because the gate voltage $V_G$ of the N-type power transistor Q would not vary therewith. Even when the Rds-on of the power transistor Q would be increased with the rise of the temperature when the power transistor Q is turned on (the Rds-on behaves with positive temperature coefficient), but in the embodiment, the level of the DC voltage $V_{BUS}$ provided by the power conversion stage 203 is mainly controlled by a feedback from the gate of the N-type power transistor Q, so that there is no need to change the reference voltage Vref because the gate voltage $V_G$ of the N-type power transistor Q would not vary therewith. In this way, the invention can substantially simplify the control mechanism of the LED driving apparatus 20.

Furthermore, even though the voltage at the node N1 is a relatively high level (normally, tens of volts) during the process of non-dimming (at the time, the current flowing through the LEDs L is zero), due to the scheme of the invention that the level of the DC voltage $V_{BUS}$ provided by the power conversion stage 203 is mainly controlled by a feedback from the gate of the N-type power transistor Q, hence, the gate voltage $V_G$ of the N-type power transistor Q is a relatively low level during the process of non-dimming. As a result, the embodiment has no need to follow the prior art where a high-voltage switch is employed to avoid the internal components of the LED driving apparatus 20 from damage.

Although in the above-mentioned embodiment, the LED driving apparatus 20 is used to drive, for example, a single LED string for explanation, but the invention is not limited to. In more details, when the LED driving apparatus 20 is used to drive a plurality of sets of LED strings connected in parallel, the control mechanism for the current flowing through each the LED string is similar to the above-mentioned embodiment, which is omitted to describe. In terms of controlling the DC voltage $V_{BUS}$ provided by the power conversion stage 203, it is needed to additionally employ a maximum voltage selection circuit (not shown) so as to select one of the N-type power transistors with the maximum gate voltage $V_{Gmax}$ to the error amplifier EA, and the error amplifier EA thereby can control the level of the DC voltage $V_{BUS}$ provided by the power conversion stage 203.

In summary, in the LED driving apparatus provided by the invention, the level of the DC voltage provided by the power conversion stage is controlled by a feedback from the gate of the power transistor, and the reference voltage received by the error amplifier is designed to be equal to the voltage value of the first operational amplifier operated in the saturation area. Accordingly, in comparison with the prior art, the invention not only substantially simplifies the control mechanism of the LED driving apparatus, but also has no need to change the reference voltage received by the error amplifier (under the situation of changing the current flowing through the LED string) and to adopt the switch for avoiding the internal components of the LED driving apparatus from damage.

It will be apparent to those skilled in the art that the descriptions above are several preferred embodiments of the invention only, which does not limit the implementing range of the invention. Various modifications and variations can be made to the structure of the invention without departing from the scope or spirit of the invention. The claim scope of the invention is defined by the claims hereinafter. In addition, any one of the embodiments or claims of the invention is not necessarily achieve all of the above-mentioned objectives, advantages or features. The abstract and the title herein are used to assist searching the documentations of the relevant patents, not to limit the claim scope of the invention.

What is claimed is:

1. A light emitting diode driving apparatus, suitable to drive at least a light emitting diode string; the light emitting diode driving apparatus comprising:

a first operational amplifier, having a positive input terminal receiving a predetermined voltage related to a current flowing through the light emitting diode string;

a first resistor, having a first end coupled to a negative input terminal of the first operational amplifier and a second end coupled to a ground;

a power transistor, having a gate coupled to an output terminal of the first operational amplifier, a drain coupled to a cathode of the light emitting diode string and a source coupled to the first end of the first resistor;

an error amplifier, having a first input terminal coupled to the gate of the power transistor, a second input terminal receiving a reference voltage and an output terminal outputting a control voltage;

a power conversion stage, coupled between the output terminal of the error amplifier and an anode of the light emitting diode string, for providing a DC voltage to the anode of the light emitting diode string according to a level of the control voltage;

a second operational amplifier, having a negative input terminal receiving a bandgap voltage;

a first transistor, having a gate coupled to an output terminal of the second operational amplifier, a source coupled to a system voltage and a drain coupled to a positive input terminal of the second operational amplifier;

a second resistor, having a first end coupled to the positive input terminal of the second operational amplifier and a second end coupled to the ground;

a second transistor, having a gate coupled to an output terminal of the second operational amplifier, a source coupled to the system voltage and a drain producing the predetermined voltage; and a third resistor, having a first end coupled to the drain of the second transistor and a second end coupled to the ground.

2. The light emitting diode driving apparatus as claimed in claim 1, wherein the reference voltage is a fixed value, and the fixed value is determined by a voltage value of the first operational amplifier operated in a saturation area.

3. The light emitting diode driving apparatus as claimed in claim 2, wherein when a voltage of the gate of the power transistor is greater than the reference voltage, the control voltage output from the error amplifier makes the DC voltage provided by the power conversion stage increase.

4. The light emitting diode driving apparatus as claimed in claim 2, wherein when a voltage of the gate of the power transistor is less than the reference voltage, the control voltage output from the error amplifier makes the DC voltage provided by the power conversion stage decrease.

5. The light emitting diode driving apparatus as claimed in claim 1, wherein there is a ratio relationship between a resistance of the second resistor and a resistance of the third resistor.

6. The light emitting diode driving apparatus as claimed in claim 5, wherein the ratio relationship is used to determine a level of the predetermined voltage.

7. The light emitting diode driving apparatus as claimed in claim 1, wherein the second resistor is a variable resistor.

8. The light emitting diode driving apparatus as claimed in claim 1, wherein both the first transistor and the second transistor are P-type power transistors and the power transistor is an N-type power transistor.

* * * * *